United States Patent [19]

Samolis

[11] 4,266,380

[45] May 12, 1981

[54] HIGH STRENGTH COVER FOR UNDERGROUND UTILITY BOX

[75] Inventor: Alfonso A. Samolis, Danville, Calif.

[73] Assignee: Christy Concrete Products, Inc., Colma, Calif.

[21] Appl. No.: 10,513

[22] Filed: Feb. 9, 1979

[51] Int. Cl.[2] ..... E02D 29/14

[52] U.S. Cl. ..... 52/19; 404/25

[58] Field of Search ..... 52/19, 20; 49/133, 33, 49/67; 404/25

[56] References Cited

U.S. PATENT DOCUMENTS

| | | | |
|---|---|---|---|
| 1,068,856 | 7/1913 | Clay | 49/33 |
| 1,244,501 | 10/1917 | Jackson | 404/25 |
| 2,765,752 | 10/1956 | Imming | 404/25 |
| 3,087,178 | 4/1963 | Loomis | 404/25 |
| 3,521,537 | 7/1970 | Forni | 404/25 |

*Primary Examiner*—Ernest R. Purser
*Assistant Examiner*—Henry E. Raduazo
*Attorney, Agent, or Firm*—Thomas H. Olson

[57] ABSTRACT

A high strength cover for an underground utility box of the type that is normally installed on streets and driveways and is subjected to substantial vehicle loads. The cover structure includes a fixed rectangular frame the upper edge of which is installed substantially flush with the ground level. Below the ground level the frame defines bearing surfaces throughout the periphery of the frame, the inner edge of the bearing members defining the access opening. Two structural frameworks, dimensioned to be, in combination, substantially coextensive with the access opening are provided to span the bearing surfaces. The frameworks have sufficient vertical dimensions to afford the necessary strength. The frameworks are hinged for pivotal movement about axes along two opposite ends of the frame so that they can be moved to an upright position to afford access to the box. Hingedly mounted on a side edge which extends between the end edges of the frame are two cover plates which in combined outlinear form cover the access opening. The cover plates are impervious so as to close the access opening and when closed are supported by the subjacent frameworks. The cover plates are also provided with brackets which engage the frameworks in the upstanding position so as to form a barrier around three sides of the opening when access to the box is desired.

7 Claims, 10 Drawing Figures

HIGH STRENGTH COVER FOR UNDERGROUND UTILITY BOX

BACKGROUND OF THE INVENTION

1. Field of the Invention

This invention relates to a cover for an underground utility box and more particularly to a cover that combines high load-bearing capacity with relative ease in opening.

2. Description of the Prior Art

As far as is presently known the procedure for closing an underground utility box that is located in areas where it is subjected to heavy traffic loads is to provide steel covers of one or more pieces which require a hoist to lift the same when access to the box is needed. Such procedure not only complicates access to the box interior and requires the use of heavy machinery but further requires, when the cover has been removed, the erection of temporary barriers to protect passersby from injuries should they inadvertently fall into the open box.

SUMMARY OF THE INVENTION

A box cover according to the present invention is mounted in a rectangular frame which is constructed of L-shaped members which have a vertical leg and a horizontal leg. The upper edge of the vertical leg is typically installed flush with the ground level or pavement surface and the horizontal leg forms a bearing surface for supporting the members that comprise the cover. Such members include two structural frameworks that have sufficient vertical extent to provide the strength to resist buckling when subjected to loads. The frameworks are hinged or otherwise pivoted to the opposite end edges of the frame so that the frameworks can be pivoted upward about parallel spaced-apart axes when access to the box interior is desired. For overlying the frameworks when they are in their closed position, there are two impervious plates which are coextensive with the access opening and which rest on the frameworks. The cover plates can be hinged or otherwise pivoted at a side edge of the frame that extends between the end edges thereof. When the cover plates and the frameworks are raised, the adjacent corners are interengaged, which retains the members in an upstanding position to afford access to the box and form a safety barrier around three sides of the access opening.

An object of the present invention is to provide a high strength cover for underground boxes which can be opened by persons of moderate strength without the use of hoisting equipment. This object is achieved by dimensioning each of the elements of the cover structure so that no element is more than half as large as the box opening. Accordingly, a box cover according to the invention can be readily opened by persons of moderate strength.

Another object of the invention is to provide a box cover which can be designed to meet or exceed loading specifications imposed by government agencies having jurisdiction over highways and streets. The principal strength of the cover is provided by structural frameworks, which because they recess into the frame, can be formed of material having a vertical dimension sufficient to meet loading requirements. The frameworks are formed of members that are relatively closely spaced apart so that the impervious cover, typically a steel plate, is supported at close intervals throughout the extent of the plate.

A further object of the invention is to provide a cover which when moved to an open position will produce a barrier around three sides of the box opening. Achievement of this object is particularly important for boxes placed in city streets where pedestrians abound. The object is accomplished by the present invention by dimensioning the above mentioned frameworks and plates such that when they are raised and engaged with one another, they will be self-supporting, thus forming the barrier without requiring transportation of equipment from site to site.

Yet another object is to provide a box cover which can be quickly opened without special tools. This object is achieved by spring loading one of the plates and providing a locking mechanism which can be released so as to permit the spring force to raise the plate by a distance sufficient to permit a hand hold thereunder.

The foregoing together with other objects, features and advantages will be more apparent after referring to the following specification and the accompanying drawings.

DESCRIPTION OF THE PREFERRED EMBODIMENT

Figure 6:
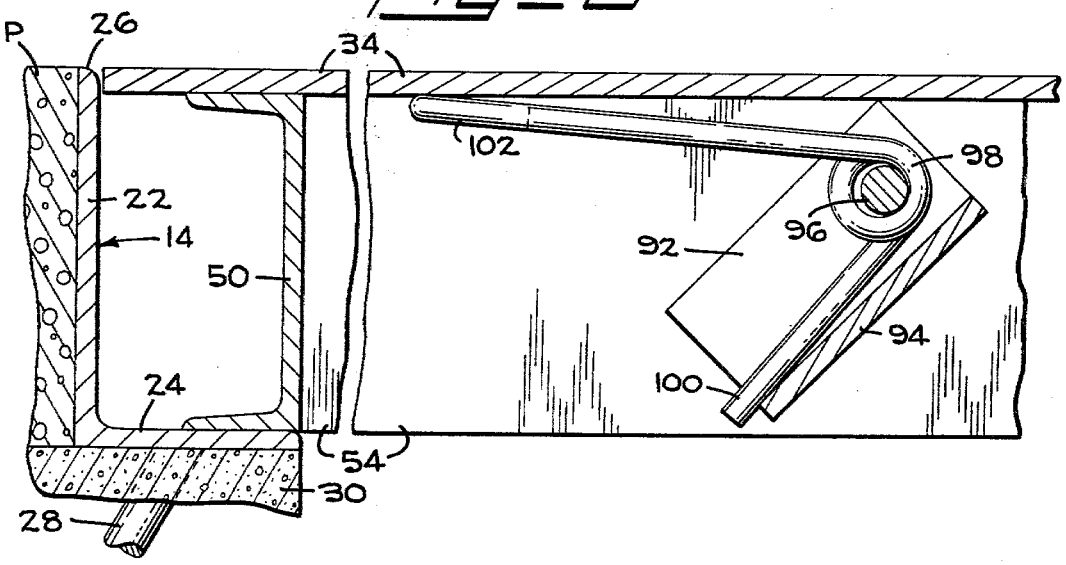
FIG. 6 is an enlarged fragmentary section showing the spring biasing structure of the invention, taken along line 6—6 of FIG. 2.

Referring more particularly to the drawings, reference numeral 12 indicates a frame which is formed of side edge members 14 and 16 and end edge members 18 and 20 which are rigidly joined to one another to form a rectangular frame. As seen most clearly in FIG. 6 the frame members, as exemplified by side edge member 14, are of L-shaped cross section and have a vertical leg 22 and a horizontal leg 24. When the structure is installed in its operative position, the upper extremity 26 of vertical leg 22 resides flush with the ground level or pavement surface. The upper surface of horizontal leg 24, which is spaced below upper edge 26, forms a bearing surface for other parts of the cover. Welded to the exterior of frame 12 and extending obliquely therefrom is a plurality of reinforcing bars 28. The reinforcing bars are imbedded in a concrete rim 30 which is provided to form a support surface which bears on the earth in which the cover is installed and which facilitates proper positioning of the cover before pavement is installed therearound. As seen in FIG. 6, the inner extremity of concrete rim 30 is substantially coextensive with the inner extremity of horizontal leg 24 so as to define an access opening for the box formed below the cover.

Figure 1:
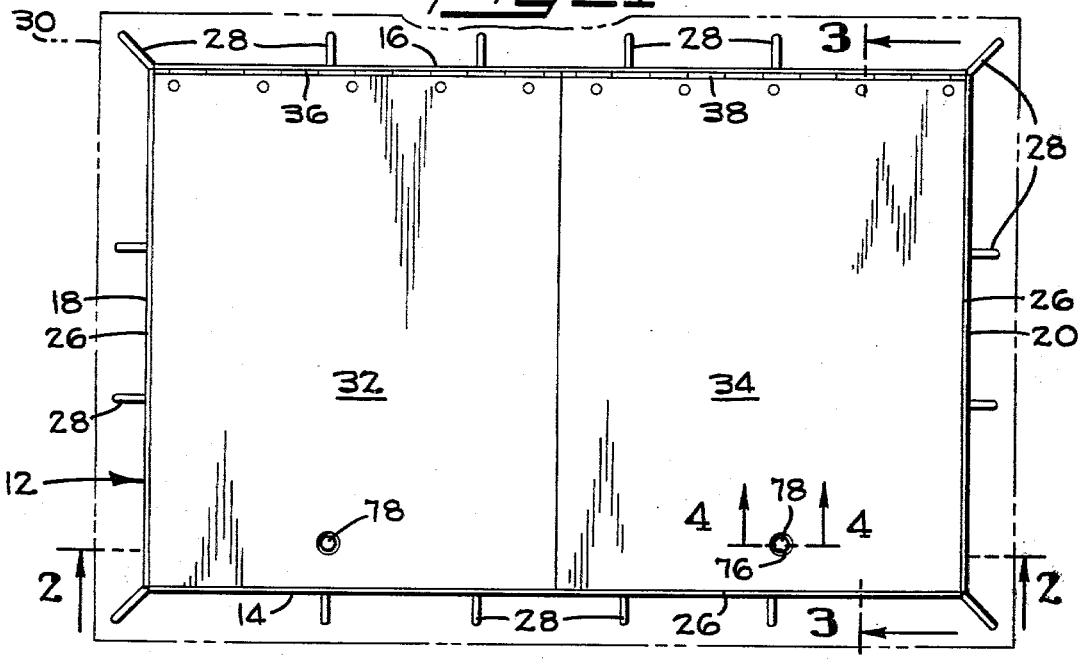
FIG. 1 is a plan view of a box cover according to the present invention in a closed condition.

Two impervious cover plates 32 and 34 are provided. As can be seen most clearly in FIG. 1 cover plates 32 and 34 are rectangular and each occupies substantially one half of the area bounded by the vertical legs of the members that define frame 12 so that the combined outlinear shape of the cover panels totally covers or closes the access opening. The cover panels are mounted for pivotal movement on an axis substantially coextensive with the upper extremity 26 of frame member 16, there being a hinge 36 for so mounting cover plate 32 and a hinge 38 for so mounting cover plate 34.

Figure 7:
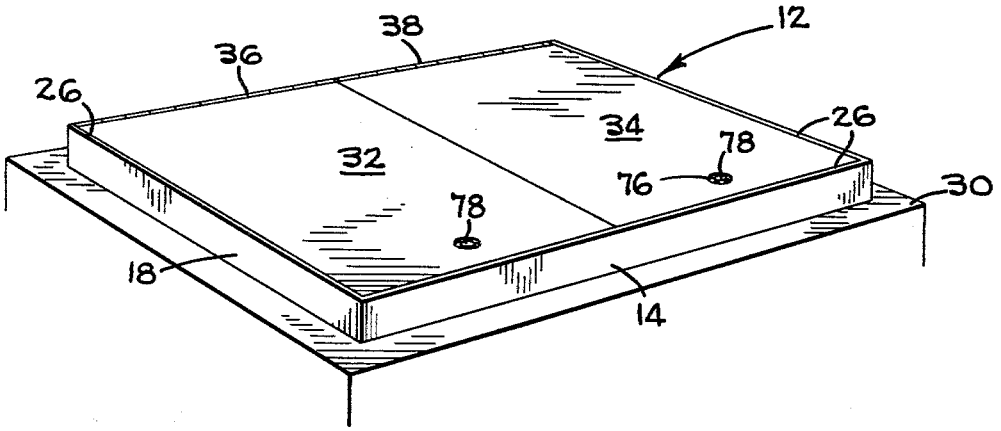
FIG. 7 is a perspective view of a cover according to the invention in the closed condition.
Figure 8:
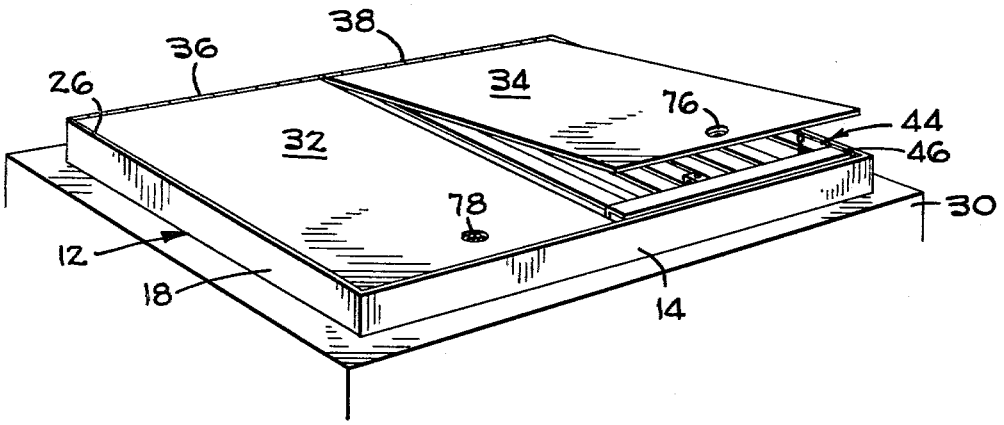
FIG. 8 is a view similar to FIG. 7 showing the cover in a partially open condition.

A framework 40 having an outlinear shape corresponding to that of plate 32 is pivotally joined to end frame member 18 by a hinge 42. A substantially similar shaped framework 44 is pivotally joined to end frame member 20 by a hinge 46. Framework 44 includes longitudinally extending channels 48 and 50 and transversely extending channels 52, 54, 56, 58 and 60. The transverse channels are parallel to one another and are uniformly spaced apart so that in the closed position shown in FIG. 7, the frameworks are subjacent the plates and the maximum span of any part of cover plate 32 will be such as to avoid overloading of the cover plate.

Figure 2:
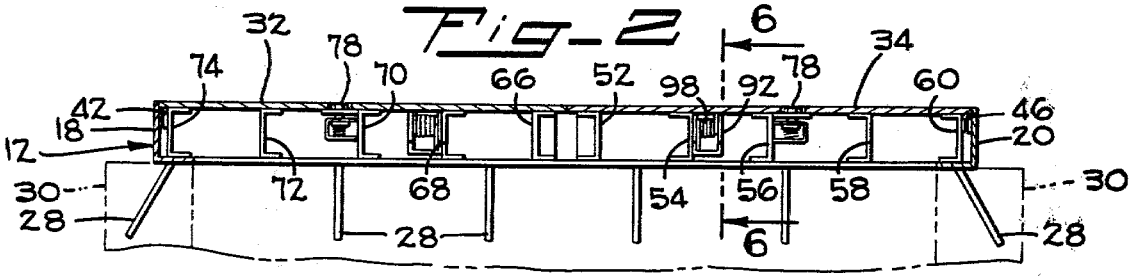
FIG. 2 is a vertical section taken along line 2—2 of FIG. 1.
Figure 3:
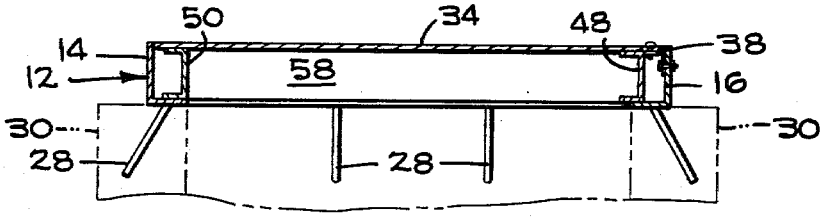
FIG. 3 is a vertical section taken along line 3—3 of FIG. 1.
Figure 9:
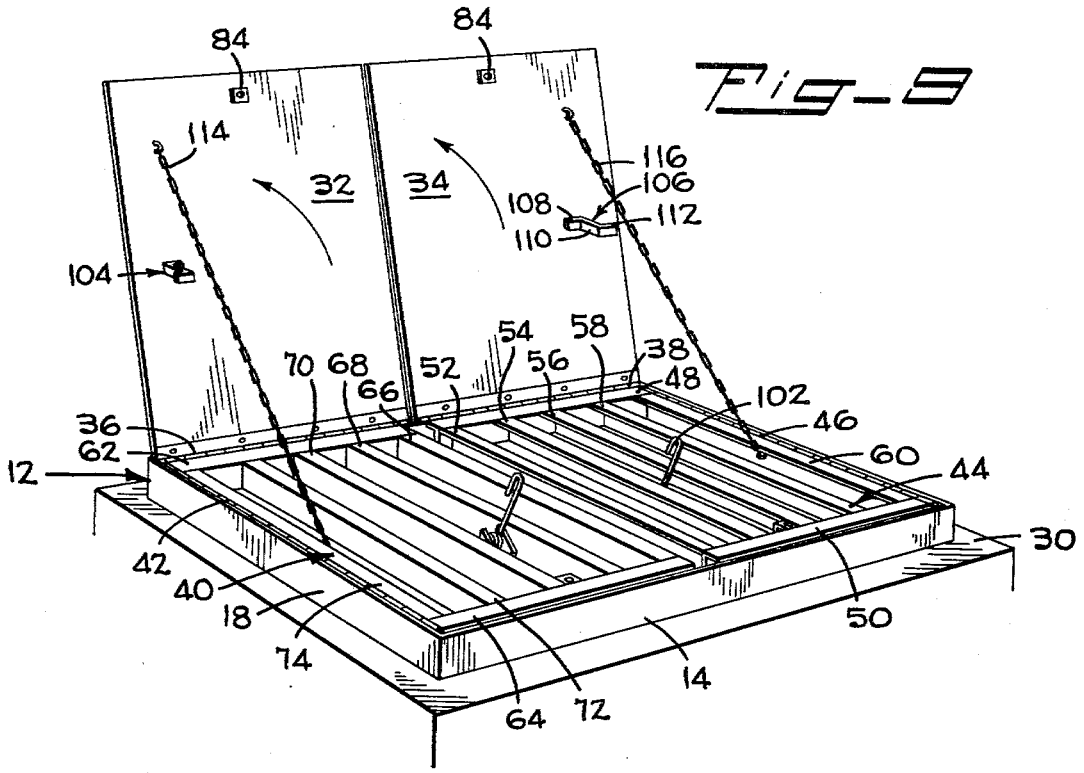
FIG. 9 is a view similar to FIG. 7 showing the cover in another partially opened condition.

The channel members that constitute framework 44 each have a vertical web of a thickness and height such as to provide adequate strength for loads that are imposed by vehicles and the like that pass over the cover. As can be seen in FIGS. 2 and 9 the pin of hinge 46 that defines the pivot axis about which framework 44 moves is located at or near the upper extremity of the members that define the framework. As will be explained subsequently such position of the hinge gravitationally biases the framework in an inner direction.

Framework 40 is substantially identical to framework 44. Framework 40 includes longitudinally extending channels 62 and 64 between which extend in parallel uniformly spaced apart relation transverse channels 66, 68, 70, 72 and 74. Because the construction and arrangement of framework 40 is substantially identical to framework 44, no further detail description of framework 40 will be given.

When the box cover is in the closed condition, the ends of the transverse channels of frameworks 40 and 42 are supported on the horizontal legs 24 of the members that form frame 12. As seen most clearly in FIG. 2, the upper vertical extremity of the frameworks is below the upper vertical extremity 26 of frame 12 by an amount equal to the thickness of plates 32 and 34.

Figure 4:
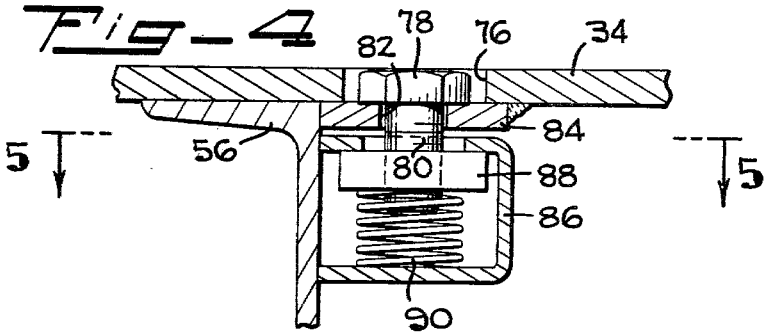
FIG. 4 is an enlarged fragmentary section taken along line 4—4 of FIG. 1.
Figure 5:
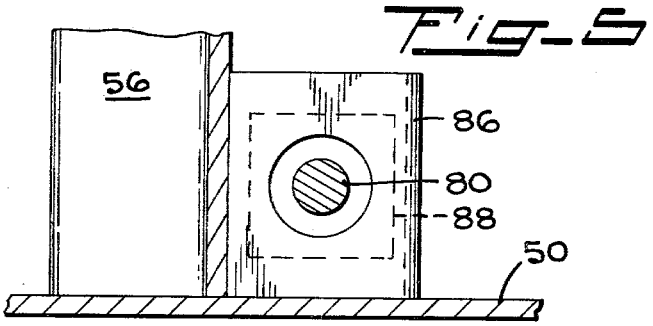
FIG. 5 is a horizontal section taken along line 5—5 of FIG. 4.

The cover is retained in a closed condition by releasable engaging means shown in FIGS. 4 and 5. Plate 34 is provided with a hole 76 which is sized to receive a bolt head 78. Typically the thickness of bolt head 78 is equal to or less than the thickness of plate 34 so that the bolt head does not protrude above the surface of plate 34. A threaded bolt shank 80, which is integral with bolt head 78, extends through a hole 82 in a steel pad 84 which is welded to the lower surface of plate 34. Holes 82 and 76 are coaxial. Secured to transverse frame member 56 is a cage bracket 86 which captures a square nut 88. Nut 88 has a threaded hole for threaded engagement with the threads on bolt shank 80. A compression spring 90 is provided for retaining nut 88 in the cage bracket in position for threaded engagement with the bolt. Thus when shank 80 is engaged with nut 88, the bolt can be tightened by engagement with bolt head 78 so as to secure the cover in the closed position shown in FIG. 7.

Plates 32 and 34 are typically formed of relatively heavy steel plate. Because the fit between the edges of the plates and the members constituting frame 12 is a close one, it is desirable to provide apparatus for affording a grip on the plates when access to the box interior is desired. Such apparatus is shown in detail in FIG. 6. A U-shaped bracket 92 is welded or otherwise secured to transverse member 54 at a location near cage bracket 86 and remote from hinge 38. The U-shaped bracket has a web 94 that projects outward from transverse member 54 and is oriented obliquely as seen in FIG. 6. The bracket supports a pin 96 on which is mounted a spring having a coil section 98, a first leg 100 supported on web 94 and a second leg 102 which bears on the lower surface of cover plate 34. The spring is tensioned so that legs 100 and 102 are biased away from one another. Consequently, when bolt shank 80 is disengaged from nut 88, the force stored in the spring raises cover plate 34 by an amount sufficient to afford access for the fingers beneath the plate. Similar elements are provided for facilitating a grip in plate 32.

Figure 10:
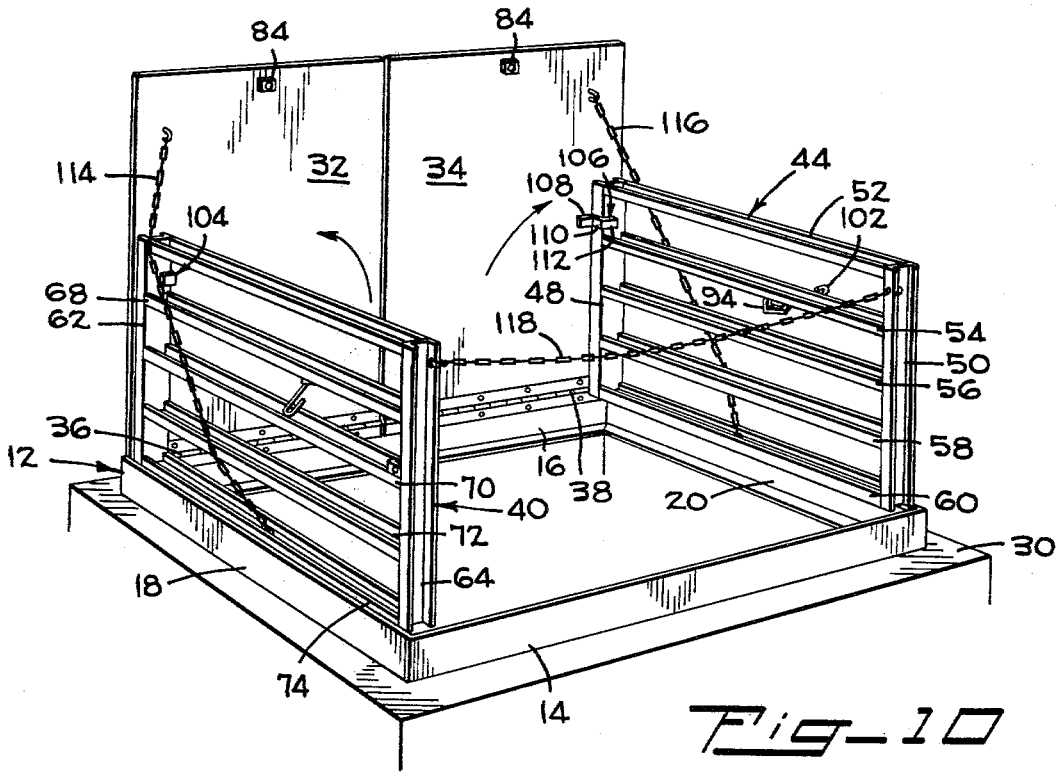
FIG. 10 is a view of the cover in a full open condition.

For retaining plates 32 and 34 and frameworks 40 and 44 in a safe upright condition at such times as access to the box is had, there are installed on the lower surfaces of cover plates 32 and 34 adjacent the outer margins thereof respective brackets 104 and 106. Bracket 106, which is typical, includes a mounting leg 108 which is welded to the underside of cover plate 34, a vertical leg 110 which projects substantially perpendicularly to the undersurface of the cover plate and a horizontal leg 112 which extends outward from the distal end of the vertical leg. The length of the vertical leg is such that the space between horizontal leg 112 and the lower surface of cover plate 34 is equal the horizontal dimension of longitudinal frame member 48 of framework 44. Brackets 104 and 106 are positioned with respect to the lateral edge of the respective cover plates on which they are mounted such that when longitudinal legs 48 and 62 of respective frameworks are engaged with the brackets, as shown in FIG. 10, the frameworks are approximately vertical. In this condition the frameworks are gravitationally biased into firm engagement with the brackets because the weight of the frameworks is inward of the pivot axis defined by hinges 42 and 46.

As can be seen in FIGS. 9 and 10, there is a chain or like tension member 114 which extends from transverse member 74 of framework 40 to the underside of cover plate 32. There is also a chain or like tension member 116 which extends from transverse member 60 of framework 44 to the underside of cover plate 34. As can be seen in FIG. 9, the length of chains 114 and 116 is such as to permit cover plates 32 and 34 to be moved to a position about ten degrees beyond a vertical position. Because the chains extend exteriorly of at least some of the framework channels, the chains limit the outward movement of frameworks 40 and 42 as shown in FIG. 10. Thus the cover of the invention can be opened and locked in the position of FIG. 10 safely and without damage to the person so manipulating the parts of the cover. Also as can be seen in FIG. 10 when the frameworks and the covers are erected, a barrier around three sides of the box opening is formed.

In operation the cover in accordance with the invention is installed when the underground box is constructed. Concrete rim 30 both affords rigidity to the structure and provides a base which facilitates accurate positioning of the cover and connection thereof to the walls of the underground box. Installation is completed by installing paving material P, the level of which corresponds with upper edge 26 of the frame members that constitute frame 12 which is also at the same level as cover plates 32 and 34. When the cover is retained in a closed position, by engagement of threaded bolt shank 80 with nut 88 in the respective covers, a smooth surface supported on the subjacent frameworks is provided. Because the members of which frameworks 40 and 42 are composed bear on the surface formed by leg 24 of the members that constitute frame 12, the frameworks are virtually immovable. The spacing between the transverse channels of the frameworks is such that the unsupported span of plates 32 and 34 is sufficiently small to avoid deformation of the plates in response to movement of heavy loads thereover.

When access to the underground box is desired bolt head 78 associated with cover plate 34 is engaged with a wrench and shank 80 is disengaged from nut 88. Upon such disengagement the energy stored in spring coil 98 acting through leg 102 of the spring raises cover plate 34 by an amount sufficient to afford a finger grip beneath the free or unhinged side of cover plate 34. The cover plate is then raised to a position beyond vertical and is there retained by chain 116. Cover plate 32 is similarly raised after the bolt 78 associated therewith is loosened. Next one of the frameworks, for example framework 44, is lifted slightly beyond a vertical position so that it clears leg 112 of bracket 106. Chain 116 prevents framework 44 from inadvertently falling outward. Cover plate 34 is then moved near a vertical position, and channel 48 of the framework is moved into engagement with the portion of the bracket between the lower surface of cover plate 34 and leg 112 so as to effect engagement between the framework and the cover plate and retain them in the upright position shown in FIG. 10. This upright position is maintained because framework 44 is gravitationally biased about the axis of hinge 46 to urge the framework into engagement with the clamp. Thereafter framework 40 is similarly manipulated into engagement with clamp 104 on cover plate 32 and a barrier bounding three sides of the opening is thus formed. It is noted that the presence of chains 114 and 116 prevents movement of frameworks 40 and 44, respectively, outward of a vertical position by any significant degree. Finally a safety chain 118 can be attached to the upper ends of members 50 and 64 of frameworks 44 and 40, respectively, so that all four sides of the box opening are protected from inadvertent entry by passersby.

The cover plates, which are approximately half the size and weight of unitary cover plates now in use, can be raised to the open condition by persons of moderate strength. In a like manner frameworks 40 and 44 can be similarly raised because of their relatively light weight. Thus it will be seen that the present invention provides a box cover structure which can be dimensioned to accommodate virtually any loading requirements and which can be manipulated by persons of moderate strength. Finally the structure is arranged so that there are no loose parts which can be mislaid.

Although one embodiment of the invention has been shown and described it will be obvious that other adaptations and modifications can be made without departing from the true spirit and scope of the invention.

What is claimed is:

1. A high strength cover for an underground utility box adapted to be installed substantially flush with ground level comprising a substantially rectangular frame including mutually parallel end members defining first and second end edges and mutually parallel side members defining first and second side edges that are perpendicular to the end edges so as to define therewith a substantially rectangular access opening, first and second substantially congruent rectangular structural frameworks having a combined outlinear shape adapted to fit in said access opening, said structural frameworks being formed by elongate structural members having vertical dimensions adequate to resist bending of the frame in response to loads imposed thereon, first and second hinge means for joining the edges of respective frameworks to respective said end edges to afford hinged movement of said frames, first and second substantially congruent cover plates which in combination have an extent sufficient to cover said access opening, third and fourth hinge means for joining said cover plates to said first side edge for hinged movement on an axis perpendicular to the axes of movement of said frameworks, said plates in the lower position closing said access opening and being supported by said frameworks, and means for releasably engaging respective said plates to respective said frameworks when the same are pivoted upward so as to define an upstanding barrier on three sides of said rectangular opening.

2. A cover according to claim 1 wherein said first and second hinge means are mounted adjacent the upper vertical extremity of said frameworks and wherein said releasable engaging means comprise first and second brackets fixed to the underside of respective said plates, each said bracket having a vertical leg projecting perpendicularly from the surface of said plate and a horizontal leg extending from the distal end of the vertical leg and oriented outward, said horizontal legs being spaced from the underside of respective said plates by a distance sufficient to afford entry of said elongate structural members therebetween, said vertical legs being spaced from the outer edges of respective said plates by a distance approximately equal to the vertical extent of said elongate structural members so that when said frameworks are engaged in said brackets said frameworks are gravitationally biased into contact with said vertical legs of respective said brackets.

3. A cover according to claim 1 including means for releasably engaging respective said plates to respective said frames in the closed position and means active upon release of at least one of said engaging means for resiliently biasing one of said plates upward so that upon release of said engaging means said plate rises so as to afford a hand grip thereunder.

4. A cover according to claim 3 wherein said releasable engaging means comprises a bolt having threaded shank and a head accessible from the upper surface of said plate, said plate defining a clearance opening for said shank, and means secured to said frame defining an interiorly threaded opening for threaded engagement with said bolt, said biasing means comprising a coil spring having a leg bearing against the lower surface of said plate adjacent said bolt.

5. A cover according to claim 1 wherein said frame members are formed by L-shaped members having a vertical leg substantially equal to the sum of the vertical extent of said frameworks and the thickness of said plates and a horizontal leg extending from the lower extremity of the vertical leg and forming a bearing surface for said frameworks.

6. A high strength cover for an underground utility box adapted to be installed substantially flush with ground level comprising a substantially rectangular frame including mutually parallel end members defining first and second end edges and mutually parallel side members defining first and second side edges that are perpendicular to the end edges so as to define therewith a substantially rectangular access opening, first and second frameworks constituting a pair of framework members which in combined outlinear shape are substantially coextensive with said access opening, first and second impervious plates forming a pair of plate members which in combined outlinear shape are substantially coextensive with said access opening, first and second pivot means for pivotally mounting respective members of one said pair of members on respective said end edges for pivotal movement between a position overlying said access opening and an upright position, third and fourth pivot means for pivotally mounting the members of the other said pair of members on said first side edge for pivotal movement between a position overlying said access opening and an upright position, said plates being superjacent said frameworks when the members are in the position overlying said access opening, first releasable engaging means for releasably engaging said first framework and said first plate to retain them in an upright position, and second releasable engaging means for releasably engaging said second framework and said second plate to retain them in an upright position.

7. A cover for an access opening in an underground utility box wherein the access opening is defined by a rim, the cover comprising first and second frameworks constituting a pair of framework members which in combined outlinear shape correspond to the shape of the opening, first and second impervious plates forming a pair of plate members which in combined outlinear shape correspond to the shape of said opening, first and second pivot means for mounting respective members of one said pair to said rim for pivotal movement about respective axes that are parallel and spaced diametrically of said opening, third and fourth pivot means for mounting the members of the other said pair to said rim for pivotal movement about an axis perpendicular to and intermediate said axes, said plates being superjacent said frameworks when the members are in the position overlying said access opening, first releasable engaging means for releasably engaging said first framework and said first plate to retain them in an upright position, and second releasable engaging means for releasably engaging said second framework and said second plate to retain them in an upright position.

* * * * *